US007853180B2

(12) United States Patent
Wakabayashi et al.

(10) Patent No.: US 7,853,180 B2
(45) Date of Patent: Dec. 14, 2010

(54) TONER SUPPLIER, DEVELOPMENT UNIT, AND IMAGE FORMING APPARATUS

(75) Inventors: Takeshi Wakabayashi, Kizugawa (JP); Masanobu Deguchi, Kashiba (JP); Takeshi Okuda, Kizugawa (JP)

(73) Assignee: Sharp Kabushiki Kaisha, Osaka (JP)

( * ) Notice: Subject to any disclaimer, the term of this patent is extended or adjusted under 35 U.S.C. 154(b) by 232 days.

(21) Appl. No.: 12/195,817

(22) Filed: Aug. 21, 2008

(65) Prior Publication Data

US 2009/0067884 A1 Mar. 12, 2009

(30) Foreign Application Priority Data

Sep. 10, 2007 (JP) ..... 2007-233575

(51) Int. Cl.
*G03G 15/08* (2006.01)

(52) U.S. Cl. ..... 399/254

(58) Field of Classification Search ..... 399/254
See application file for complete search history.

(56) References Cited

U.S. PATENT DOCUMENTS 6,456,810 B1 * 9/2002 Deguchi et al. ..... 399/254
7,349,657 B2 * 3/2008 Sato et al. ..... 399/263
2004/0062574 A1 * 4/2004 Isomura et al. ..... 399/263

FOREIGN PATENT DOCUMENTS

| | | | | |
|---|---|---|---|---|
| JP | 3-260678 | A | | 11/1991 |
| JP | 07-261525 | | | 10/1995 |
| JP | 11058518 | A | * | 3/1999 |
| JP | 2001075343 | A | * | 3/2001 |
| JP | 2003-287949 | A | | 10/2003 |
| JP | 2004-198800 | A | | 7/2004 |
| JP | 2004-286939 | | | 10/2004 |
| JP | 2006001065 | A | * | 1/2006 |
| JP | 2006-78992 | A | | 3/2006 |

* cited by examiner

*Primary Examiner*—David M Gray
*Assistant Examiner*—G. M. Hyder
(74) *Attorney, Agent, or Firm*—Nixon & Vanderhye, PC

(57) ABSTRACT

A toner supplier according to the present invention includes a toner stirrer. The toner stirrer includes a shaft, an auxiliary member, and a fixture. The melting point of the auxiliary member is higher than the melting points of the shaft and fixture. The shaft and fixture are welded to each other with the auxiliary member interposed between them.

Because the melting point of the auxiliary member is higher than the melting points of the shaft and fixture, this member is not influenced by heat when the shaft and fixture are welded thermally to each other.

7 Claims, 4 Drawing Sheets

TONER SUPPLIER, DEVELOPMENT UNIT, AND IMAGE FORMING APPARATUS

CROSS REFERENCE

This Nonprovisional application claims priority under 35 U.S.C. §119(a) on Patent Application No. 2007-233575 filed in Japan on Sep. 10, 2007, the entire contents of which are hereby incorporated by reference.

BACKGROUND OF THE TECHNOLOGY

The present technology relates to a toner supplier including a toner stirrer. The technology also relates to a development unit including such a toner supplier. The technology further relates to an image forming apparatus including such a development unit.

In general, a toner supplier includes a toner container and a toner stirrer, which includes a shaft and an auxiliary member. The shaft needs to be strong enough to support the auxiliary member stirring the toner in the container. The auxiliary member needs to be strong enough to stir the toner, and be flexible when this member comes into contact with a wall of the container. Therefore, the shaft and the auxiliary member are made of different materials.

JP 2004-286939 A discloses a method of separately molding a shaft and an auxiliary member as parts of a toner stirrer and bonding them together.

A shaft and an auxiliary member as parts of a toner stirrer may be bonded together by being welded thermally to each other with a jig. The thermal welding is liable to cause defective calking, thereby resulting in a low manufacturing yield and low accuracy of parts.

An object is to provide a toner supplier including a toner stirrer that can be manufactured at a high yield with high part accuracy.

SUMMARY OF THE TECHNOLOGY

A toner supplier includes a toner stirrer. The toner stirrer includes a shaft, an auxiliary member, and a fixture. The melting point of the auxiliary member is higher than the melting points of the shaft and fixture. The shaft and fixture are welded to each other with the auxiliary member interposed between them.

Because the melting point of the auxiliary member is higher than the melting points of the shaft and fixture, this member is not influenced by heat when the shaft and fixture are welded thermally to each other. This prevents the auxiliary member from waving when the shaft and fixture are welded thermally to each other. Because the shaft and fixture can melt sufficiently without the auxiliary member waving, the shaft and fixture can be welded firmly to the auxiliary member. Accordingly, the toner stirrer can be manufactured at a high yield with high part accuracy.

DETAILED DESCRIPTION OF THE TECHNOLOGY

The best mode of carrying out the technology will be described below in detail with reference to the accompanying drawings.

Figure 1:
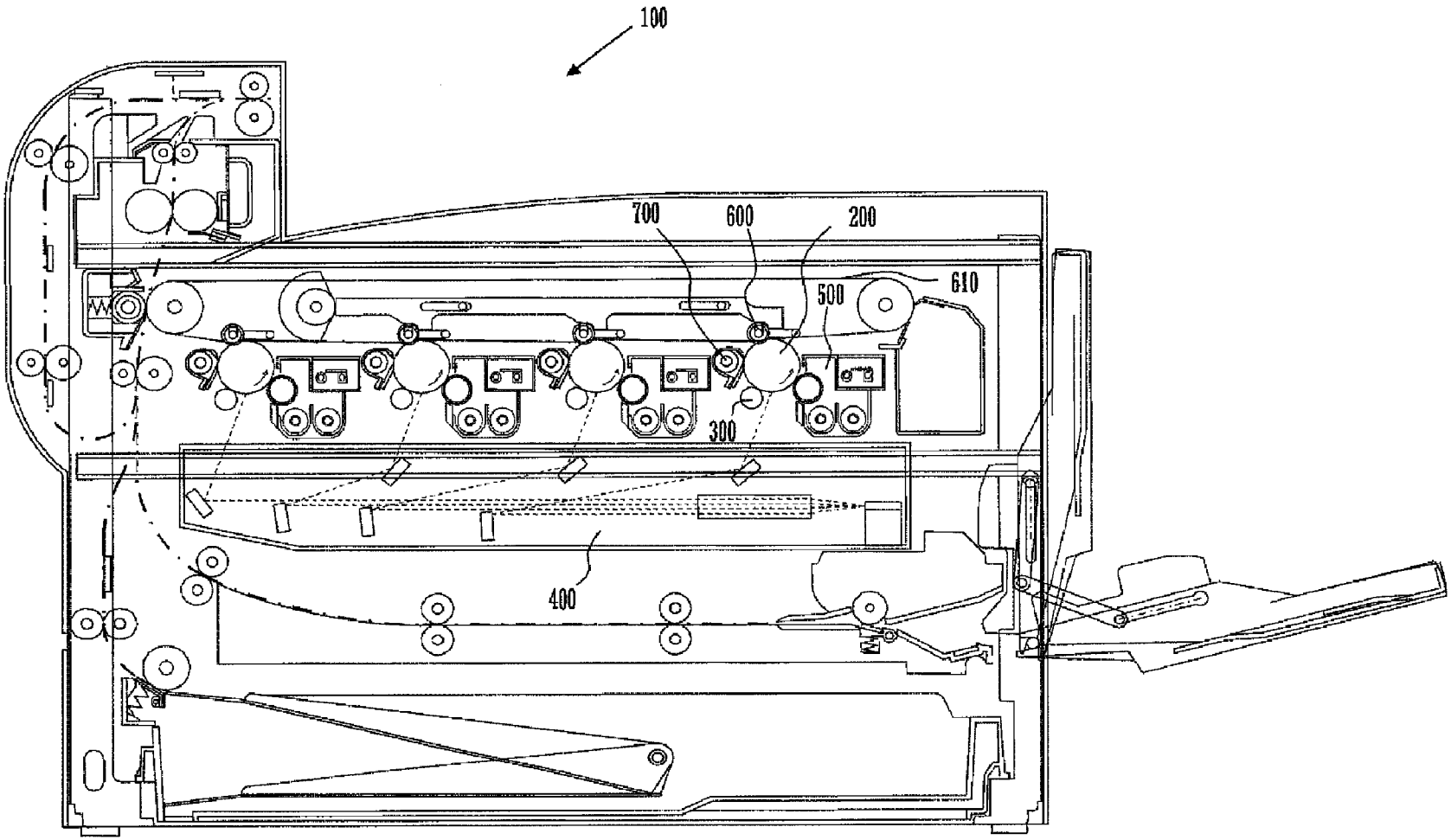
FIG. 1 is a vertical section of an image forming apparatus.

With reference to FIG. 1, an image forming apparatus 100 includes a photosensitive drum 200, a charger 300, an exposure unit 400, a development unit 500, an intermediate transfer roller 600, an intermediate transfer belt 610, and a cleaner 700.

The charger 300 charges the cylindrical surface of the photosensitive drum 200 uniformly to a preset electric potential. The exposure unit 400 exposes the drum surface to light based on image data. The exposure forms an electrostatic latent image on the drum surface. The development unit 500 includes a development roller 505, which carries toner on its cylindrical surface and makes the latent image visible with the toner. The intermediate transfer roller 600 gives a transfer bias for transferring the toner image on the drum surface onto the intermediate transfer belt 610. The cleaner 700 recovers the toner remaining on the drum surface downstream from the intermediate transfer roller 600.

Figure 2:
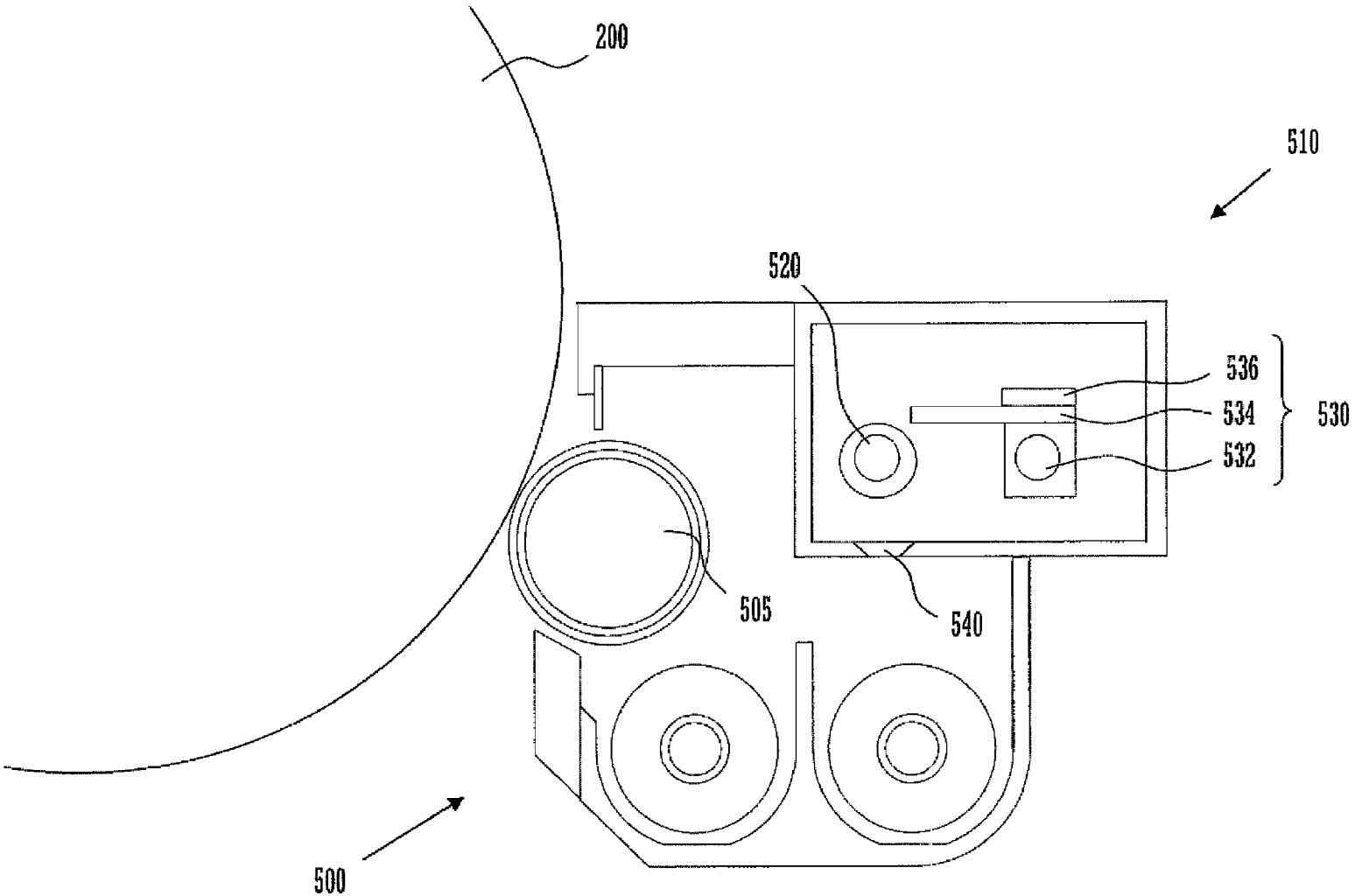
FIG. 2 is a schematic view of the development unit of the image forming apparatus.

With reference to FIG. 2, the development unit 500 is fitted with a toner supplier 510, which is filled with toner. The supply unit 510 includes a toner conveying screw 520 and a toner stirrer 530. The stirrer 530 has a shaft 532, around which it rotates to stir the toner. The supply unit 510 has toner passages (not shown) formed in walls of it, and further has a toner outlet 540, which communicates with the passages. The screw 520 conveys toner to the passages in response to a toner supply request signal from the development unit 500. The conveyed toner flows through the passages and outlet 540 to the development unit 500.

Figure 3C:
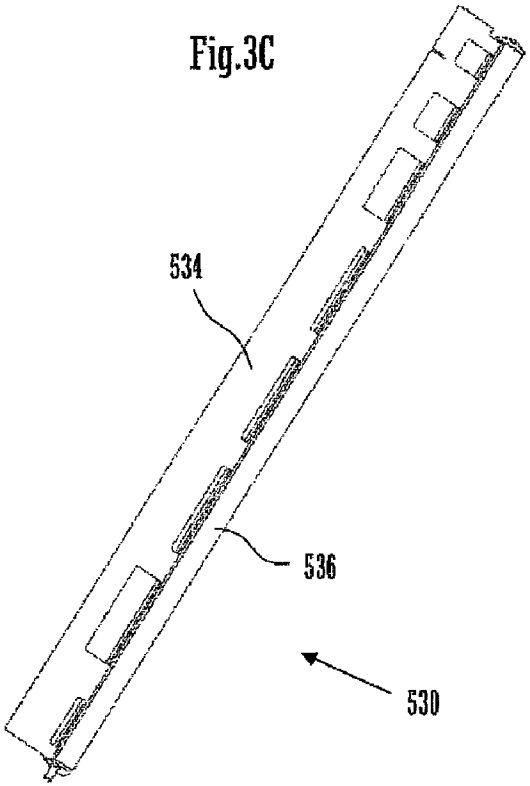
FIG. 3C is a side view of the toner stirrer, showing its shaft and fixture welded to its auxiliary member.
Figure 3B:
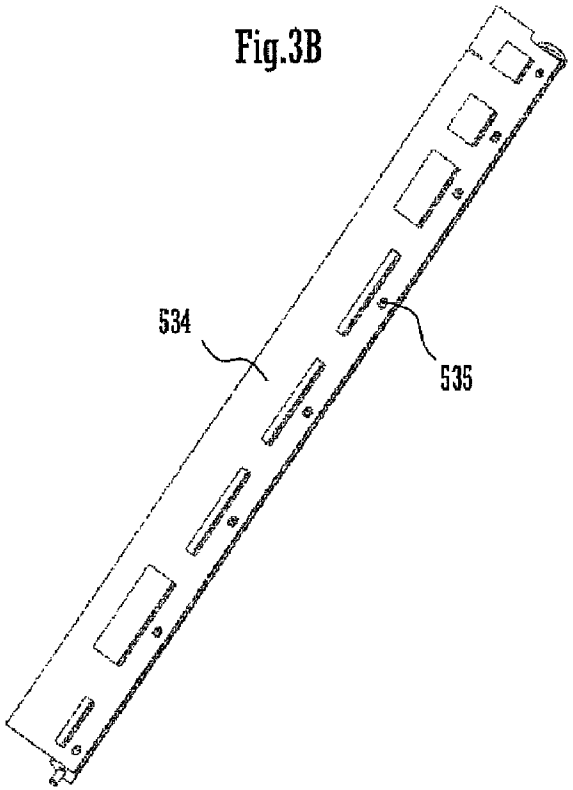
FIG. 3B is a side view of the shaft and auxiliary member of the toner stirrer, which are in engagement with each other.
Figure 3A:
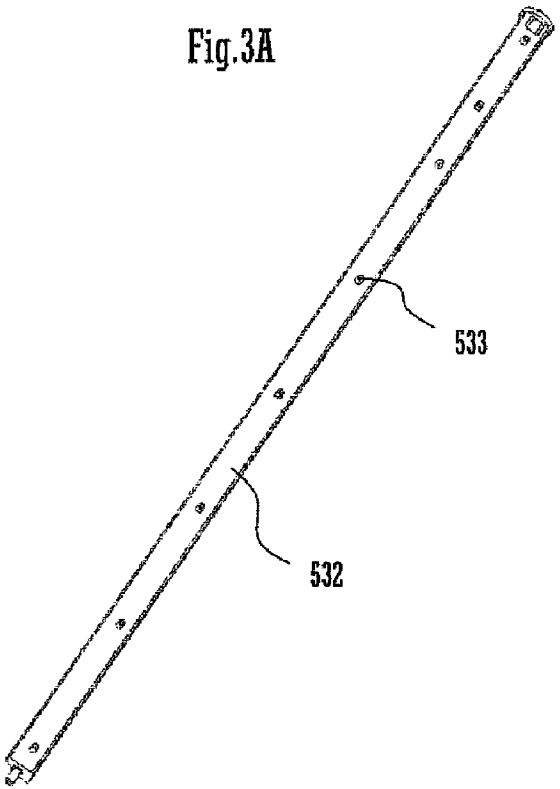
FIG. 3A is a side view of the shaft of the toner stirrer of the toner supplier of the development unit.

FIGS. 3A to 3C show the procedure for manufacturing the toner stirrer 530, which includes an auxiliary member 534 and a fixture 536. The auxiliary member 534 is made of a polyethylene terephthalate (PET) resin. The shaft 532 and fixture 536 are made of a polystyrene (PS) resin or an acrylonitrile butadiene styrene copolymer (ABS) resin. The melting point of the PET resin is 258 degrees C. The molding temperatures for PS resin and ABS resin are 200 degrees C. to 230 degrees C.

With reference to FIG. 3A, a shaft 532 is molded at a primary molding step, at which positioning bosses 533 are formed on it. The bosses 533 position the auxiliary member 534.

With reference to FIG. 3B, the auxiliary member 534 has holes 535 formed through it, which engage with the positioning bosses 533 so that the auxiliary member 534 and stirrer shaft 532 can be fixed together. The fixed member 534 and shaft 532 are set in a molding machine.

At a secondary molding step, the same kind of resin as the shaft 532 is made of is poured into the molding machine so as to form a fixture 536. This produces a toner stirrer 530, with its auxiliary member 534 molded integrally between its shaft 532 and fixture 536.

When the auxiliary member 534 is molded integrally, the shaft 532 and fixture 536 melt and are welded thermally to each other with the auxiliary member 534 sandwiched between them. This keeps these parts 532, 534 and 536 fixed together and prevents them from becoming rickety. The integral molding differs from the common manufacturing method in that the parts 532, 534 and 536 are not calked. This makes the manufacturing yield of the toner stirrer 530 less liable to decrease and the precision of parts of the stirrer less liable to decrease. The molding temperature at the secondary molding step is lower than the melting point of the auxiliary member 534. This prevents the auxiliary member 534 from waving. If the shaft 532 and fixture 536 are made of PS resin, they contract at a rate of about 1 mm for a size of 300 mm at the primary molding step, but at a rate of about 0.2 or less mm for the same size at the secondary molding step.

Figure 4A:
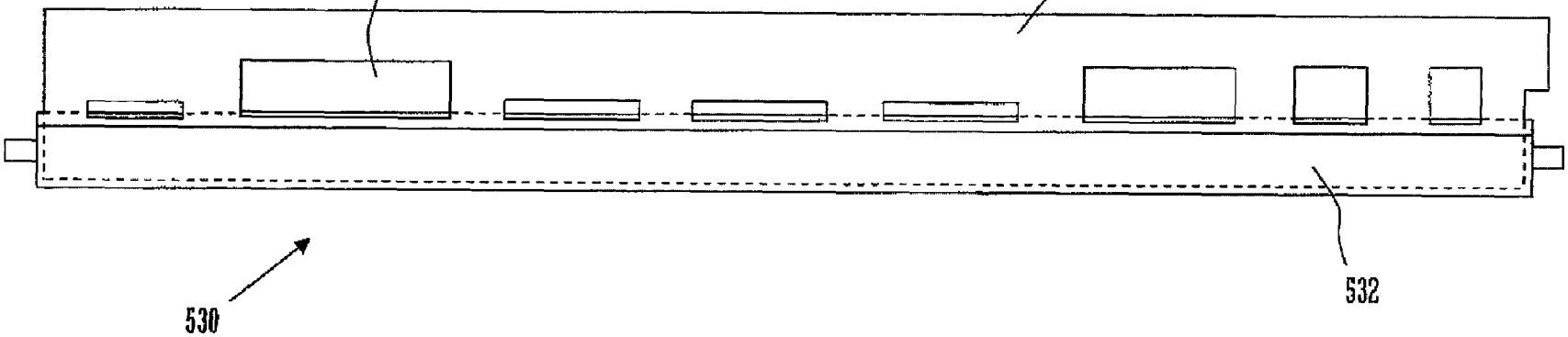
FIG. 4A is an enlarged side view of the toner stirrer.
Figure 4B:
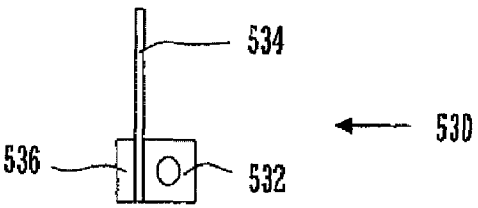
FIG. 4B is an end view of the toner stirrer.

With reference to FIGS. 4A and 4B, the auxiliary member 534 is made of PET resin, as stated already. PET resin is high in strength and does not react to styrene acryl resin and polyester resin, each of which is the main component of toner. Accordingly, PET resin is suitable as the material for the auxiliary member 534. The auxiliary member 534 has a thickness of 0.15 mm. If the auxiliary member 534 were thinner than 0.1 mm, it would be too low in strength to stir toner. If the auxiliary member 534 were thicker than 0.35 mm, it would damage walls of the toner supplier 510 and the toner conveying screw 520, and would be excessively hard. The excessively hard member 534 would increase the resistance to the rotation of the toner stirrer 530, so that the stirrer would require excessively high torque.

The auxiliary member 534 has holes 538 formed through it, through which toner passes. If toner is left at a high temperature in the toner supplier 510, the toner may become tapping. While the tapping toner is stirred, very high torque would, without the holes 538, be exerted on the auxiliary member 534. This would make it impossible to rotate the toner stirrer 530 by means of a general motor. Therefore, the holes 538 are formed so that part of the toner can escape through them.

When the auxiliary member 534 is molded integrally, it does not wave. This enables the toner stirrer 530 to stir toner uniformly. As a result, the development unit 500 and image forming apparatus 100 provide developed perfect images easily for a long period.

It will be obvious that the technology may be varied in many ways. Such variations are not to be regarded as a departure from the spirit and scope of the technology, and all such modifications as would be obvious to one skilled in the art are intended to be included within the scope of the following claims.

What is claimed is:

1. A toner supplier comprising a toner stirrer for stirring toner, the stirrer including:

a shaft formed from a resin having a first melting point and having a plurality of positioning bosses that extend from a side of the shaft;

an auxiliary member formed of a material having a second melting point higher than the first melting point and haying a plurality of positioning holes along one edge; and a fixture formed from a resin having a melting point lower than the second melting point, wherein the stirrer is formed by inserting the positioning bosses of the shaft through the positioning holes of the auxiliary member, inserting the shaft and the edge of the auxiliary member in a molding machine, injecting molten resin into the molding machine to form the fixture on a side of the auxiliary member opposite to the shaft such that the molten resin melts portions of the positioning bosses that extend through the edge of the auxiliary member, and cooling the resin so that the shaft, the positioning bosses and the fixture are part of the same unitary resin structure.

2. A toner supplier as claimed in claim 1, wherein the auxiliary member is made of polyethylene terephthalate (PET), and wherein the shaft and the fixture are made of polystyrene (PS) or acrylonitrile butadiene styrene copolymer (ABS).

3. A toner supplier as claimed in claim 2, wherein the auxiliary member has a thickness of 0.1 mm to 0.35 mm.

4. A toner supplier as claimed in claim 1, wherein the auxiliary member includes a part through which toner passes.

5. A development unit comprising:

a development roller for carrying toner thereon and a toner supplier as claimed in claim 1.

6. An image forming apparatus comprising:

a photosensitive member having a surface on which an electrostatic latent image can be formed;

a charger for charging the surface of the photosensitive member;

an exposure unit for exposing the surface of the photosensitive member to light; and a development unit as claimed in claim 5;

the development unit being adapted to make the surface of the photosensitive member carry toner.

7. A method of manufacturing a toner stirrer for a toner supplier of an image forming apparatus, comprising:

forming a shaft from a resin having a first melting point, wherein a plurality of positioning bosses extend from a side of the shaft;

positioning an edge of an auxiliary member formed of a material having a second melting point higher than the first melting point and having a plurality of positioning holes along the edge adjacent the side of the shaft such that the positioning bosses extend through the positioning holes;

inserting the shaft and the edge of the auxiliary member in a molding machine;

injecting molten resin having a melting point lower than the second melting point into the molding machine to form a fixture on a side of the auxiliary member opposite to the shaft such that the molten resin melts portions of the positioning bosses that extend through the auxiliary member; and cooling the resin so that the shaft, the positioning bosses and the fixture are part of the same unitary resin structure.

* * * * *